US005218891A

United States Patent [19]

Olson et al.

[11] Patent Number: 5,218,891

[45] Date of Patent: Jun. 15, 1993

[54] DOUBLE-ENDED REVERSIBLE BOX WRENCH WITH 7½ DEGREE SWING CLEARANCE

[75] Inventors: Gene E. Olson; William T. Pagac, both of Kenosha, Wis.

[73] Assignee: Snap-on Tools Corporation, Kenosha, Wis.

[21] Appl. No.: 611,733

[22] Filed: Nov. 13, 1990

[51] Int. Cl.[5] ..... B25B 13/06

[52] U.S. Cl. ..... 81/125.1; 81/124.3; 81/124.4; 81/177.8

[58] Field of Search ..... 81/125.1, 124.7, 124.5, 81/124.4, 124.3, 121.1, 119, 177.7, 177.8, 177.9

[56] References Cited

U.S. PATENT DOCUMENTS

| | | | |
|---|---|---|---|
| 493,051 | 3/1893 | Aberg . | |
| 964,067 | 7/1910 | Steen . | |
| 1,261,565 | 4/1918 | Leitner . | |
| 1,643,814 | 9/1927 | Peterson . | |
| 1,764,990 | 6/1930 | Schultz . | |
| 2,951,405 | 9/1960 | Engquist . | |
| 4,327,611 | 5/1982 | Catanese et al. | 81/177.9 |

FOREIGN PATENT DOCUMENTS

| | | | |
|---|---|---|---|
| 83305 | 3/1957 | Denmark | 81/124.3 |
| 396544 | 11/1922 | Fed. Rep. of Germany . | |
| 2227093 | 11/1974 | France | 81/119 |
| 357074 | 11/1972 | U.S.S.R. | 81/124.3 |
| 1603848 | 12/1981 | United Kingdom | 81/124.4 |

OTHER PUBLICATIONS

"Armstrong Tools", catalog 57, Dec. 1957, pp. 53, 58, 60, 61, and 72.

*Primary Examiner*—D. S. Meislin

*Attorney, Agent, or Firm*—Emrich & Dithmar

[57] ABSTRACT

The double-ended reversible box wrench for use with a hexagonal fastener includes two box wrenching heads interconnected by a handle shank, with each head having a double-hexagonal socket opening therethrough, each of the outwardly directed corners of which has an axis extending through the center of the socket opening. One socket has a corner inclined at an offset angle of 3¾ degrees to the shank axis and the other socket has a corner inclined at an offset angle of 11¼ degrees to the shank axis so that, by sequential application of the four wrench faces to a hexagonal fastener, the fastener maybe repeatedly rotated in the same direction while the wrench undergoes a swing of no more than 7½ degrees during any one application. A wrench with offset angles of zero degrees and 10 degrees and a pivoting head wrench are also disclosed.

3 Claims, 3 Drawing Sheets

7°-30'
11°-15'
3°-45'
22°-30'
30°
15°
L1
L2
L3
L4
10
11
12
13
14
15
16
17
17A
18
20
24
25
26
27
35
36
37
39
39a
B
C
V

DOUBLE-ENDED REVERSIBLE BOX WRENCH WITH 7½ DEGREE SWING CLEARANCE

BACKGROUND OF THE INVENTION

1. Field of the Invention

The present invention relates to box wrenches and, in particular, to double-ended, reversible box wrenches for use with polygonal fasteners.

2. Description of the Prior Art

A double-ended box wrench is one which has a handle shank interconnecting two wrenching heads, each of which has a polygonal socket opening having a plurality of corners and extending all the way through the head so as to present two wrenching faces, respectively, at the opposite ends of each opening. The two socket openings may be of the same or different sizes. The wrench is reversible if it can be flipped over to permit use of both wrenching faces of a head.

The easiest way to use a box wrench is if it can be rotated continuously through 360°. In this case, a fastener can be tightened or loosened with only a single application of a single wrenching head to the fastener. But, typically there are obstructions which prevent continuous rotation of the wrench through 360°. In such cases the fastener is rotated through a limited swing angle and then the wrenching head is removed and reapplied to the fastener in a new wrenching position for another partial rotation. But, if the permitted swing angle is less than the angle between adjacent outwardly directed corners of the socket, e.g., 60° in the case of a hexagonal socket and 30° in the case of a double-hexagonal socket (wherein a double hexagon is two superimposed hexagons rotated 30° with respect to each other), then after the initial application through the permitted swing angle, the same wrenching head cannot be reapplied to the fastener in a different position to achieve further rotation in the same direction.

In such a case, it is known that continued rotation of the fastener in the same direction by repeated applications of the wrench (hereinafter referred to as "repeated progressive rotation") can be achieved by making both socket openings the same size and orienting them at different offset angles with respect to the longitudinal axis of the handle shank. Thus, in one prior art double-ended wrench, with double-hexagonal socket openings repeated progressive rotation is achieved with a swing angle of 15° by orienting one socket opening so that an outwardly directed corner thereof is aligned with the longitudinal axis of the handle shank (i.e., an offset of 0°) and orienting the other socket opening so that an outwardly directed corner thereof is offset by 15° with respect to the longitudinal axis of the handle shank. With that wrench, repeated progressive rotation is accomplished by alternate applications of the two wrenching heads to the fastener. But repeated progressive rotation with a minimum swing angle of less than 15° has heretofore not been possible with double-hexagonal socket openings.

SUMMARY OF THE INVENTION

It is a general object of the invention to provide a double-ended box wrench which avoids the disadvantages of prior double-ended wrenches while affording additional structural and operating advantages.

An important feature of the invention is the provision of a double-ended box wrench which is reversible so that four different wrenching faces are available for application to a fastener.

Another feature of the invention is the provision of a double-ended box wrench which permits repeated progressive rotation of a fastener, where the wrench can be rotated through only a very small angle during any one application.

In connection with the foregoing feature, it is another feature of the invention to provide a double-ended box wrench of the type set forth, having polygonal socket openings with equiangularly spaced-apart corners, and which accommodates repeated progressive rotation with a minimum swing angle of only one-fourth the angle between adjacent outwardly directed corners of the socket openings.

Still another feature of the invention is the provision of a double-ended, reversible box wrench which permits repeated progressive rotation of a polygonal fastener while moving the wrench through a swing angle of only 7½°.

These and other features of the invention are attained by providing a multiple-ended reversible box wrench for use with a polygonal fastener comprising handle means including plural arms with each arm having a longitudinal axis and a free end, plural box wrenching heads equal in number to the arms and respectively integral with the free ends thereof, each of the heads having a polygonal socket opening extending therethrough, each of the socket openings being of the same size and having the same predetermined number of equiangularly spaced-apart outwardly directed corners with each of the corners having a corner axis which passes through the center of the socket opening, each of the socket openings being oriented so that one of its corner axes is inclined with respect to the longitudinal axis of the associated arm at a predetermined offset angle which is less than the angle between adjacent corner axes, one of the offset angles being A/4N and the difference between any two offset angles being an integer multiple of A/2N, where A is the angle between adjacent corner axes of the socket opening and N is the number of wrenching heads and the integer multiplier is no greater than $N-1$.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there are illustrated in the accompanying drawings preferred embodiments thereof, from an inspection of which, when considered in connection with the following description, the invention, its construction and operation, and many of its advantages should be readily understood and appreciated.

DESCRIPTION OF THE PREFERRED EMBODIMENTS

Figure 1:
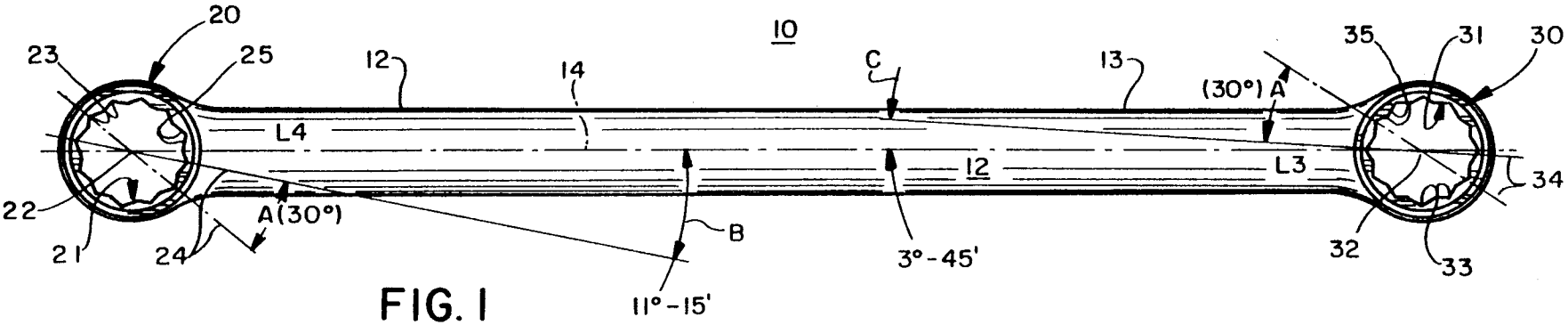
FIG. 1 is a top plan view of a double-ended box wrench constructed in accordance with and embodying the features of a first embodiment of the present invention.
Figure 2:
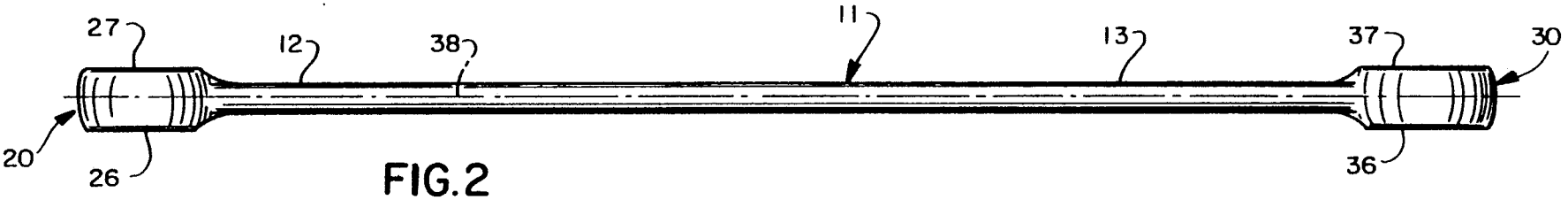
FIG. 2 is a front elevational view of the wrench of FIG. 1.
Figure 3:
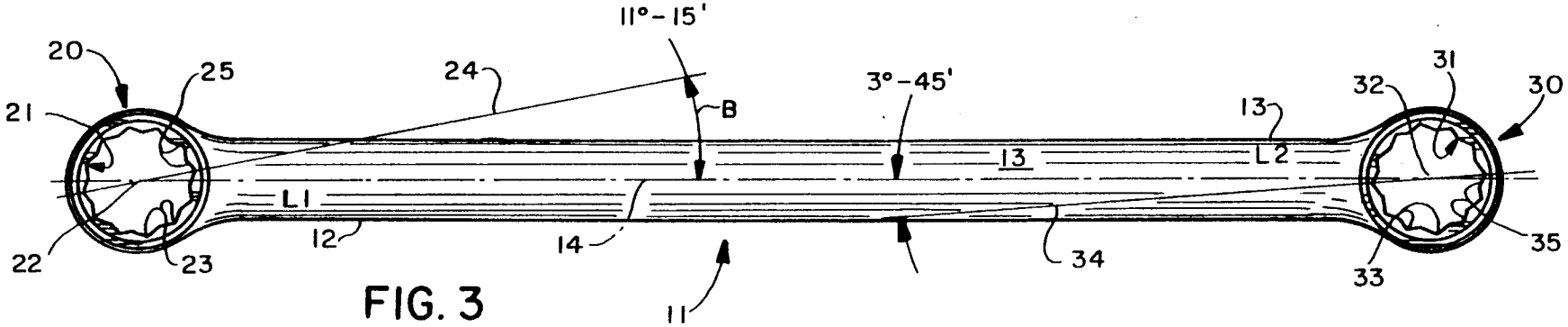
FIG. 3 is a bottom plan view of the wrench of FIG. 3.

Referring to FIGS. 1-3, there is illustrated a double-ended box wrench, generally designated by the numeral 10, in accordance with a first embodiment of the present invention. The wrench 10 is of unitary, one-piece construction and includes a generally flat handle shank 11 having two straight arms 12 and 13 joined at one end and each having a longitudinal axis. In the disclosed embodiment the arms 12 and 13 are aligned so as to have a common longitudinal axis 14, but that need not be the case. The wrench 10 is adapted for use with polygonal fasteners, such as a hexagonal fastener 15 (see FIGS. 4A-4E), which has an internally threaded opening 16 therethrough and six equiangularly spaced-apart corners 17, one of those corners 17A being illustrated darkened and having a corner axis 18 which extends through the apex of the corner 17A and through the center of the opening 16.

Respectively integral with the arms 12 and 13 at the distal ends thereof are two wrenching heads 20 and 30 which are, respectively, provided with double-hexagonal socket openings 21 and 31 therethrough. The socket openings 21 and 31 are the same size so that both are usable with the same fastener. The socket opening 21 has a center 22 and has 12 equiangularly-spaced apart and outwardly directed corners 23, each of which has a corner axis 24 extending through the apex of the corner and through the center 22 of the socket opening 21. Each of the corners 23 is defined by a pair of drive surfaces 25. The socket opening 21 extends completely through the wrenching head 20 providing two wrenching faces 26 and 27 for application to an associated fastener. Similarly, the socket opening 31 has a center 32 and 12 equiangularly spaced-apart and outwardly directed corners 33, each having a corner axis 34, and each being defined by a pair of drive surfaces 35. The socket opening 31 also extends completely through the associated wrenching head 30, providing two wrenching faces 36 and 37.

Each of the wrenching heads 20 and 30 is slightly thicker than the handle shank 11, with the drive surfaces 25 and 35 being disposed substantially perpendicular to a common medial plane 38 (FIG. 2), which is also the medial plane of the handle shank 11. The longitudinal axis 14 lies in the medial plane 38 and in a reference plane perpendicular thereto, which passes through the centers of the socket openings 21 and 31. Thus, it will be appreciated that the wrench 10 is reversible, i.e., any one of the wrenching faces 26, 27, 36 or 37 may be applied to an associated fastener without altering the inclination of the handle shank 11 with respect to the fastener axis.

It is a fundamental aspect of the present invention that it provides a unique applicability for each of the four wrenching faces 26, 27, 36 and 37. Thus, while the socket openings 21 and 31 are of identical size and shape, they are oriented differently with respect to the longitudinal axis 14 of the associated arms 12 and 13. More specifically, the socket opening 21 is oriented so that the corner 23 thereof closest to the longitudinal axis 14 is offset therefrom so that its corner axis 24 is disposed at an angle B with respect to the longitudinal axis 14. The socket opening 31, on the other hand, has its corner 33 nearest the longitudinal axis 14 offset therefrom so that its corner axis 34 defines an angle C with respect to the longitudinal axis 14. It will be appreciated that each of the angles B and C is less than the angle A between adjacent corners 23 or 33, the angle A being 30° in the case of a double-hexagonal socket opening. As is readily apparent from FIGS. 1 and 3, if B and C are different this arrangement results in four different wrenching faces, as viewed from the associated fastener, having offsets of +B, −B, +C and −C, respectively.

In the preferred embodiment of the invention, the angle B is 11°-15′, while the angle C is 3°-45′. It is a fundamental aspect of the invention that this arrangement provides a significant advantage, in that it permits repeated progressive rotation of an associated fastener 15 with the wrench 10 being rotated through a swing angle as small as 7°-30′ during any one application. This is accomplished by sequential application of all four of the unique wrenching faces 26, 27, 36 and 37 which, for ease of illustration, have been respectively designated by the labels L1, L4, L2 and L3.

Figures 4A, 4B, 4C, 4D, 4E:
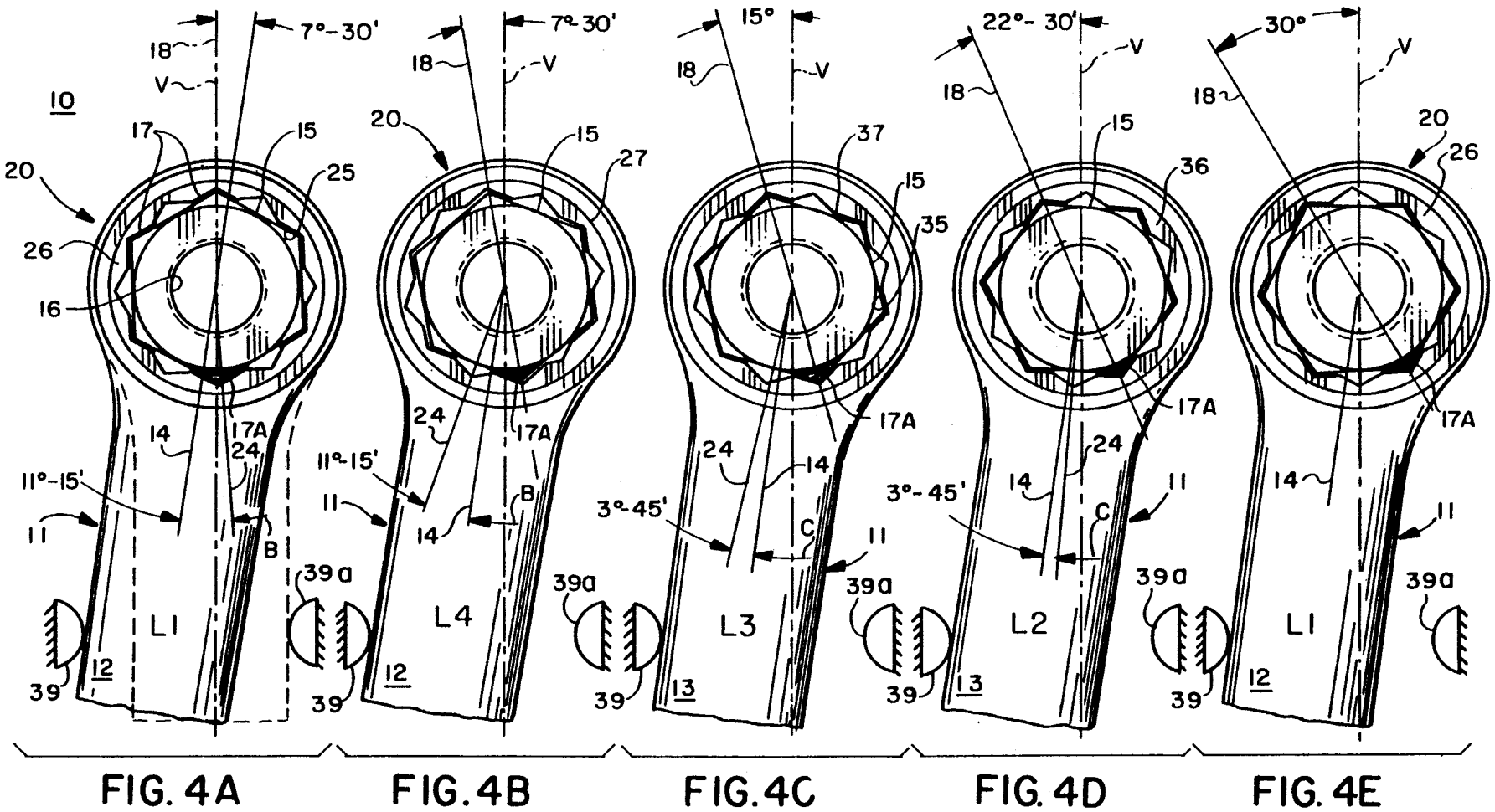
FIGS. 4A through 4E are enlarged, fragmentary views illustrating the sequence of application of the wrench of FIG. 1 to achieve repeated progressive rotation of a hexagonal fastener.

This can be explained by reference to FIGS. 4A-4E. In these figures, the wrench 10 is illustrated as being applied to a fastener 15, with the handle shank 11 being disposed between lateral obstructions 39 and 39*a* which limit the rotation of the wrench 10 during any one application to a swing angle of 7°-30′. The starting and ending positions of the handle shank 11 during such a 7½° rotation are illustrated, respectively, by the solid and broken line positions of the handle shank 11 in FIG. 4A. The starting position of the fastener 15 is illustrated in FIG. 4A with the darkened corner 17A having its corner axis 18 oriented vertically, as illustrated by the broken-line vertical axis V. It will be appreciated that, in standard fashion, the socket openings 21 and 31 are so dimensioned that there is a slight rotational clearance or "play" between the drive surfaces 25 and 35 and the sides of the fastener 15 to assure ease of application of the wrench to the fastener. Thus, the wrench 10 must undergo a very slight rotation in order to bring the drive surfaces 25 into engagement with the fastener sides, as illustrated in FIG. 4A.

Initially, the wrenching face L1 is applied to the fastener 15, this wrenching face presenting the socket opening 21 with an offset of 11¼° counterclockwise from the longitudinal axis 14 of the arm 12. When the wrench 10 is rotated 7½° counterclockwise it will rotate the fastener 15 through 7½° to the position illustrated in FIG. 4B. The wrench 10 is then turned over or reversed and the wrenching face L4 is applied to the fastener 15. It can be seen that the offset angles are such that, when the handle shank 11 is moved as far left as possible against the obstruction 39, the socket opening 21 will just fit over the fastener 15. After the wrench 10 has again been rotated through the swing angle of 7½°, the fastener 15 will have been brought to the position illustrated in FIG. 4C. The wrench 10 is then switched end for end and the wrenching face L3 is applied to the fastener 15, the angles being such that this application is permitted if the wrench is moved as far as possible to the left against the obstruction 39. A further $7\frac{1}{2}°$ counterclockwise rotation will bring the fastener to the position illustrated in FIG. 4D, at which point the wrench 10 is reversed and the wrenching face L2 is applied to the fastener. A further $7\frac{1}{2}°$ rotation will bring the fastener to the position illustrated in FIG. 4E. At this point, the fastener 15 has been rotated 30° from the starting position of FIG. 4A. Wrenching face L1 can now again be applied to the fastener 15 and the sequence can be repeated as often as is necessary to rotate the fastener 15 the desired amount.

The theory of the design of the wrench 10 will now be discussed.

It is understood that, in general, a fastener cannot be rotated in the same direction by repeated applications of the same wrenching face if the permitted swing angle is less than the angle between the corner axes of adjacent corners of the socket opening, which angle is designated A in FIG. 1. For example, for the double-hexagonal socket openings of FIG. 1, the angle A is 30°. Accordingly, if, the maximum swing angle permitted by environmental obstructions is less than 30°, the face L1 (or a face identical to it), for example, cannot be reapplied to the fastener. The present invention minimizes the swing angle which will accommodate repeated progressive rotation of a fastener. This is accomplished by offsetting the socket openings with respect to the longitudinal axes of the associated arms.

Figure 5:
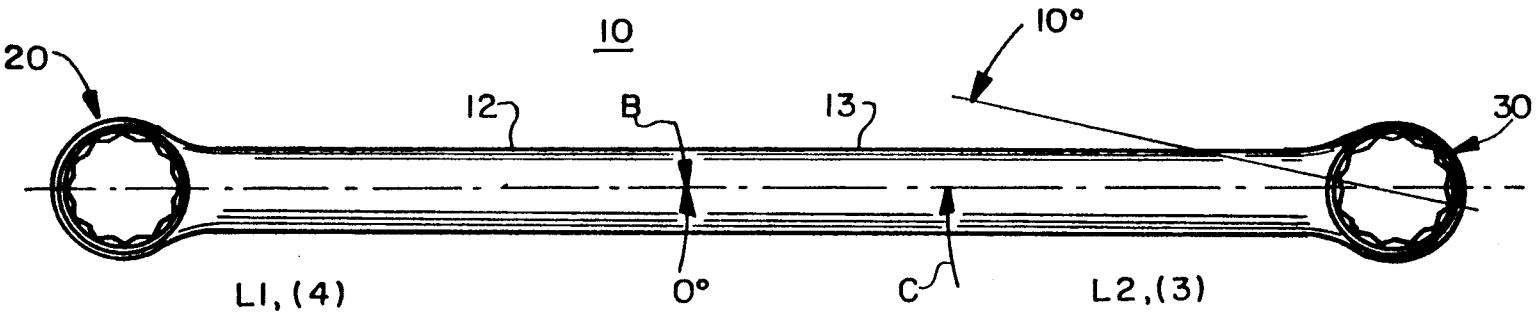
FIG. 5 is a reduced, top plan view of a double-ended box wrench constructed in accordance with and embodying the features of the second embodiment of the present invention.

One fundamental aspect of the invention is that, for any given wrench, it provides a number of unique wrenching faces which is greater than the number of wrenching heads, and it accomplishes this by providing, for any one wrenching head, two unique wrenching faces. This is achieved by orienting the polygonal socket opening so that the outwardly directed corner thereof nearest the longitudinal axis of the associated arm has a corner axis which is offset with respect to the arm axis by a predetermined angle which has a magnitude greater than zero and less than the angular distance between adjacent outwardly directed corners of the socket opening. More specifically, it will be noted that if the offset angle of a socket opening has a magnitude greater than zero, its corner axes will be inclined with respect to the longitudinal axis of the associated arm. In this event, as can be seen in FIGS. 1 and 3, the opposite wrenching faces of the wrenching head are different since, for one face the offset angle will be in a clockwise direction while, for the opposite face, the offset angle will be in a counterclockwise direction. If, on the other hand, the offset angle is zero (see FIG. 5), i.e., a corner of the socket opening has its corner axis aligned with the longitudinal axis of the associated arm, then the two opposing faces of that wrenching head will be identical so that, effectively, only one wrenching face is provided by that wrenching head. Accordingly, the number F of different wrenching faces provided by the wrench is given by the expression 2N–M, where N is the number of wrenching heads and M is the number of heads wherein the socket opening has an offset angle of zero degrees.

Furthermore, applicants have determined a relationship among the offset angles of the several socket openings which will permit repeated progressive rotation of an associated fastener with a minimum swing angle during any one application which is inversely proportional to the number of the unique wrenching faces used. More specifically, applicants have determined that, in the case where none of the offset angles is zero, one of the offset angles must be A/4N, and the difference between any two offset angles must be be an integer multiple of A/2N, wherein the integer multiplier is no greater than N−1. Thus, for example, in the embodiment illustrated in FIGS. 1–3, where A=30° and N=2, one angle is $A/4N=30°/8=3\frac{3}{4}°$, and the difference between the offset angles must be $(A/2N)(N-1)=(30°/4)(1)=7\frac{1}{2}°$. Thus, $B=C+7\frac{1}{2}°=3\frac{3}{4}°+7\frac{1}{2}°=11\frac{1}{4}°$. If these relationships are followed, then A/F is the minimum swing angle necessary to ensure repeated progressive rotation of the fastener and, therefore, represents the lower limit of the swing angle permitted by environmental obstructions. In this case, the minimum swing angle, A/2N, is $7\frac{1}{2}°$.

It will be appreciated that, for any given shape of socket opening, i.e., for any given angle A, the swing angle necessary to ensure repeated progressive rotation will be minimized only if none of the socket openings has an offset angle of 0 degrees, since this condition provides the maximum number of different wrenching faces. However, repeated progressive rotation of the fastener is still possible, even if one of the socket openings has an offset angle of zero degrees, as long as the difference between any two offset angles is an integer multiple of A/(2N−1), wherein the integer multiplier is no greater than N−1. Thus, for example, referring to the embodiment of FIG. 5, there is shown a wrench 10A which is identical to FIG. 1 except for the magnitude of the angles B and C and therefore, uses the same reference numerals for like parts. If the offset angle B is zero degrees, then $$C-B=[A/(2N-1)][N-1]=[30°/(4-1)][1]=10°.$$

Since B=0°, then C must be 10°. It follows that the minimum swing angle, A/2N, is 10°.

While the preferred embodiments disclose double-ended wrenches, since that is the standard configuration, the principles of the present invention would apply equally well if the wrench had more than two arms and associated wrenching heads. Furthermore, while the preferred embodiments of the invention are illustrated with double-hexagonal socket openings, since these are standard socket opening shapes, it will be appreciated that the principles of the present invention would apply to socket openings having any regular polygonal or double-regular polygonal shape. Thus, for example, for a three-headed wrench with hexagonal socket openings, repeated progressive rotation of a fastener could achieved with a minimum swing angle of A/2N $=60°/(2\times3)=10°$. This result would be obtained by making one offset angle A/4N=5°. It follows that the other offset angles must be 5°+A/2N and 5°+2(A/2N), i.e., 15° and 25°.

Figure 6:
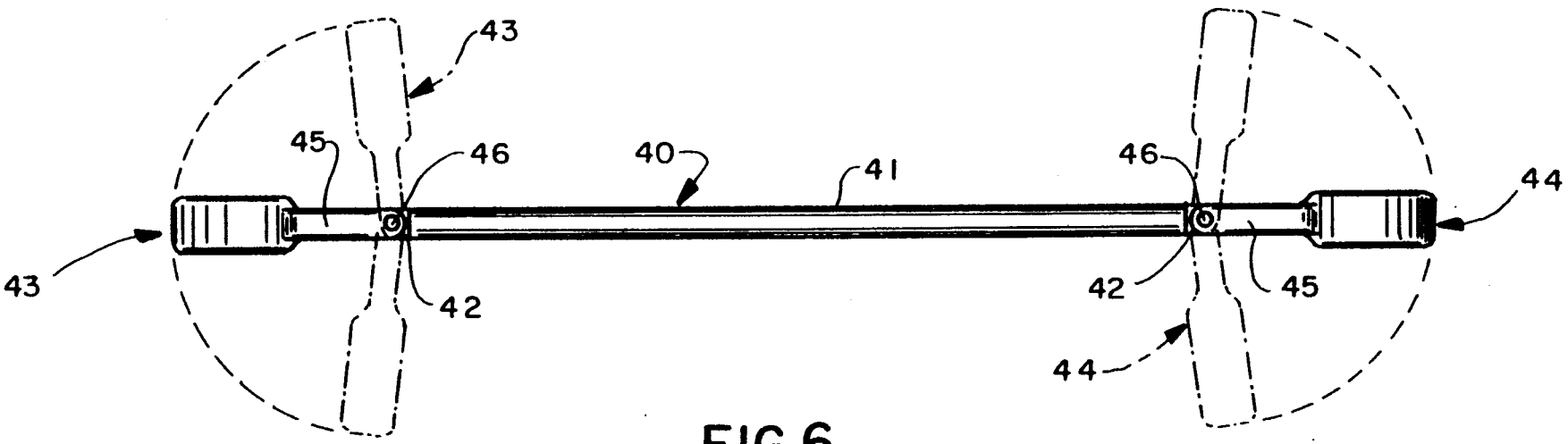
FIG. 6 is a side elevational view of a double-ended box wrench in accordance with another embodiment of the invention, illustrating pivoting movement of the wrenching heads.

Referring now to FIG. 6, there is illustrated an alternative embodiment of the wrench of the present invention, generally designated by the numeral 40, having an elongated handle shank 41 provided at its opposite ends with projecting tongues 42. Wrenching heads 43 and 44 are coupled to the opposite ends of the handle shank 41, each of the wrenching head 43 and 44 having a clevis end 45 which straddles the associated tongue 42 and is pivotally coupled thereto as by a pivot pin 46. Thus, it will be appreciated that each of the wrenching heads 43 and 44 is pivotally movable, as indicated in FIG. 6, about the axis of the associated pivot pin 46 for changing the inclination of the wrenching head 43 with respect to the longitudinal axis of the handle shank 41. The wrench 40 permits the handle shank 41 and the user's hand to be inclined at various angles with respect to the fastener axis to clear adjacent obstructions. It will be appreciated that the wrench 40 may use any of the types of socket opening configurations described above to permit repeated progressive rotation of a fastener with a minimal swing angle, even with difficult fastener locations.

From the foregoing, it can be seen that there has been provided an improved double-ended wrench which permits repeated progressive rotation of the fastener through a minimal swing angle.

We claim:

1. A reversible box wrench for use with a polygonal fastener comprising: handle means including two arms integral with each other and with each arm having a longitudinal axis and a free end, two box wrenching heads respectively integral with the free ends of said arms, each of said heads having a polygonal socket opening extending entirely therethrough and having the same configuration for the entire depth thereof, each of said socket openings being of the same size and having the same predetermined number of equiangularly spaced-apart outwardly directed corners with each of said corners having a corner axis which passes through the center of the socket opening, each of said socket openings as viewed from its center having one of its corner axes angularly displaced clockwise from the longitudinal axis of the associated arm at a predetermined offset angle which is less than the angle between adjacent corner axes, said offset angles being respectively zero degrees and ten degrees.

2. The wrench of claim 1, wherein the angle between adjacent corner axis is 30 degrees.

3. The wrench of claim 1, wherein each of said wrenching heads is pivotally movable with respect to its associated arm.

* * * * *